US012017810B2

(12) United States Patent
Cox et al.

(10) Patent No.: US 12,017,810 B2
(45) Date of Patent: Jun. 25, 2024

(54) DEVICE AND METHOD FOR FORMING BUNDLES OF INDIVIDUAL PACKAGES

(71) Applicant: KHS GmbH, Dortmund (DE)

(72) Inventors: Bernd Cox, Weeze (DE); Michael Jörissen, Bedburg-Hau (DE); Thomas Lelie, Kleve (DE)

(73) Assignee: KHS GmbH, Dortmund (DE)

( * ) Notice: Subject to any disclaimer, the term of this patent is extended or adjusted under 35 U.S.C. 154(b) by 184 days.

(21) Appl. No.: 17/629,113

(22) PCT Filed: Jul. 13, 2020

(86) PCT No.: PCT/EP2020/069715

§ 371 (c)(1),
(2) Date: Jan. 21, 2022

(87) PCT Pub. No.: WO2021/018558

PCT Pub. Date: Feb. 4, 2021

(65) Prior Publication Data

US 2022/0274723 A1 Sep. 1, 2022

(30) Foreign Application Priority Data

Jul. 31, 2019 (DE) ..... 102019120676.6

(51) Int. Cl.
*B65B 11/10* (2006.01)
*B65B 21/24* (2006.01)
*B65B 57/08* (2006.01)

(52) U.S. Cl.
CPC ..... *B65B 11/10* (2013.01); *B65B 21/245* (2013.01); *B65B 57/08* (2013.01)

(58) Field of Classification Search
None
See application file for complete search history.

(56) References Cited

U.S. PATENT DOCUMENTS 3,629,991 A * 12/1971 Sundin ..... B65B 49/08 53/590
3,965,645 A * 6/1976 Ganz ..... B65B 11/004 53/442

(Continued)

FOREIGN PATENT DOCUMENTS

CN 104349979 A * 2/2015 ..... B65B 11/10
DE 4307934 A1 9/1993

(Continued)

OTHER PUBLICATIONS

International Search Report, PCT Application No. PCT/EP2020/069715, mailed Nov. 5, 2020 (3 pages).

*Primary Examiner* — Tanzim Imam
(74) *Attorney, Agent, or Firm* — Occhiuti & Rohlicek LLP

(57) ABSTRACT

A bundling machine includes a wrapper that wraps the combination while it rests on a forward end of a paper cutout and a rear end of the paper cutout overlaps the forward end of the paper cutout while the combination moves in a transport direction, a transporter having a wrapping belt and a removal belt that follows the wrapping belt along the transport direction for conveying the combination of packages along a transport plane in the transport direction through the wrapper, and a controller that controls the relative speed of the belts so that, while the combination contacts both belts, the wrapping belt moves faster than the removal belt, thereby causing the rear end to sustain a tension in the direction of the forward end.

18 Claims, 2 Drawing Sheets

(56) References Cited

U.S. PATENT DOCUMENTS

| | | | | |
|---|---|---|---|---|
| 4,706,444 | A | 11/1987 | Gambetti | |
| 2012/0117923 | A1 * | 5/2012 | Hastreiter | B65B 11/10 53/461 |

FOREIGN PATENT DOCUMENTS

| | | | | |
|---|---|---|---|---|
| DE | 102008052633 | A1 | 4/2010 | |
| DE | 102014113393 | A1 * | 3/2016 | B65B 11/04 |
| EP | 0049377 | A1 | 4/1982 | |
| EP | 3181466 | A1 * | 6/2017 | B65B 11/10 |
| EP | 3181466 | A1 | 6/2017 | |
| EP | 3441315 | A1 * | 2/2019 | B65B 11/10 |

* cited by examiner

DEVICE AND METHOD FOR FORMING BUNDLES OF INDIVIDUAL PACKAGES

RELATED APPLICATIONS

This is the national stage of international application PCT/EP2020/069715, filed on Jul. 13, 2020, which claims the benefit of the Jul. 31, 2019 filing date of German application DE 102019120676.6, the contents of which are herein incorporated by reference.

FIELD OF INVENTION

The invention relates to bundling machines for bundling a combination of containers filled with liquid into a bundle by wrapping with a packaging material.

BACKGROUND

Known bundling machines wrap a combination of containers in plastic film to form bundles. Examples of containers include those filled with beverages and liquid foodstuffs, such as bottles, cans, beakers, pouches, and cubical cartons, with or without spouts. Materials from which such containers are made include glass, plastic, metal, cardboard, and combinations thereof.

To form a film wrapping that is closed on all sides, folding tabs that project laterally over the sides of the combination are brought in contact on the sides of the package combination. The subsequent shrinkage of the film then stabilizes the containers so that they do not move relative to each other.

The use plastic film has become undesirable because of its ecological impact and its lack of recyclability. It is therefore desirable to use more environmentally-friendly materials for the production of bundles. However, without the ability to shrink wrap, it becomes difficult to ensure a taut bundle. This results in instability.

One can correct for this instability by using cardboard. However, this has the adverse effect of a high usage of material.

SUMMARY

An object of the invention is that of providing a device and a method which allow for the production of bundles formed as stable packaging units with the use of non-shrinkable packaging materials.

Characteristic of the device according to the invention for the formation of bundles from individual packages is the fact that the device comprises a control system, which is configured such as to control the wrapping belt and/or the removal belt in such a way that the wrapping belt, when in operation, exhibits at least intermittently a higher belt speed than the removal belt in such a way that the end of the cutout, formed from a paper material, referred to hereinafter as a paper cutout, at the transition from the package combination from the wrapping belt onto the removal belt, is pre-tensioned in the direction onto the forward end of the cutout.

Subject to the reservation of an individual divergent description, in this situation a wrapping belt or removal belt respectively are understood to be any conveying means, or a plurality of conveying means, arranged in or transverse to the transport direction, suitable for conveying the group of individual packages in the transport direction, with or without an underlying transport element, such as a tray, a cardboard cutout, or the like.

According to the invention, provision is made for the wrapping belt and the removal belt to exhibit belt speeds which differ from each other, wherein the removal belt, arranged behind the wrapping belt in the transport direction, has a lower belt speed. During the transport through the wrapping unit in the transport direction, the package combination is intermittently in engagement with both the removal belt as well as with the wrapping belt. During this transition of the package combination from the wrapping belt onto the removal belt, the rear end of the cutout is guided under the forward end of the cutout. Due to the slower belt speed of the removal belt in relation to the wrapping belt, the paper cutout is set under tension and tautened, wherein a wrapped rear end of the paper cutout is drawn in the direction onto its forward end. The overall result of this is that, in a circumferential direction corresponding to the transport direction, a taut contact of the paper cutout to the package combination is produced. As a result of this, the possibility is provided of producing a bundle formed as a stable packaging unit, making use of a packaging cutout formed from a paper material which represents a perceptibly more environmentally-friendly packaging material in comparison with plastic material.

A major element of the device according to the invention is that the removal belt circulates at a lower belt speed than the wrapping belt, as a result of which the paper cutout surrounding the package combination is tautened in the transport direction, and the rear end of the cutout can be fixed to the forward end under tension. In this situation, the degree of tautening taking effect on the paper cutout is a dependency of the speed difference between the belt speeds. According to one advantageous embodiment of the invention, provision is made in this situation for the control system to be configured so as to control the wrapping belt and/or the removal belt in such a way that the wrapping belt, when in operation, exhibits at least intermittently a belt speed which is 1.25 to 2 times higher than the belt speed of the removal belt. Characteristic of a corresponding speed difference between the belt speeds is that, while avoiding any damage to the paper cutout, an adequate tautening of the paper cutout is achieved which is sufficient for producing a bundle which is formed as a stable packaging unit.

In principle, by the use of a wrapping belt and a removal belt with different belt speeds it is already possible to ensure a sufficiently taut contact of the paper cutout with the package combination. A belt speed difference must only be present if the package combination is in engagement with both the wrapping belt as well as the removal belt. After a complete transfer of the package combination to the removal belt, i.e. when the package combination is no longer in an effective connection with the wrapping belt, the removal belt can then be speeded up, wherein the removal belt can then also exhibit a belt speed which is above the belt speed of the wrapping belt, as a result of which the situation can be reached in which, despite a temporary braking effect due to the wrapping belt temporarily having a slower belt speed, the package combinations which are to be wrapped then still have the same distance intervals between them both before and after the wrapping unit.

According to one advantageous further embodiment of the invention, provision is made for a conveyor belt to connect to the removal belt in the transport direction, wherein the removal belt is configured so as to receive only one packaging unit. The use of a separate conveyor belt connecting to the removal belt in the transport plane, of which the speed can be freely chosen, allows for the package combinations to be guided through the wrapping unit particularly conveniently, while maintaining a consistent distance interval between them. Preferably, after a complete transfer onto the removal belt the package combination is speeded up, in order to ensure a continuous wrapping process inside the wrapping unit.

As well as the speed difference in the belt speed of the wrapping belt and the removal belt, the adherence between the wrapping belt and the removal belt and the paper cutout is also of significance for the tension which can applied to the paper cutout in the direction onto the forward end of the paper cutout. According to an advantageous further embodiment of the invention, provision is made for an adhesion friction coefficient between a first contact surface of the wrapping belt, which can be brought into engagement with the package combination, and the paper material is higher than the adhesion friction coefficient between a second contact surface of the removal belt, which can be brought into engagement with the package combination, and the paper material. Corresponding adhesion friction coefficients can be attained, for example, by a coating of the wrapping belt and/or the removal belt. For example, in order to attain a higher adhesion friction coefficient between the wrapping belt and the paper material, the contact surface of the wrapping belt can be provided with a PU coating, or the wrapping belt is formed from a PU material. As a result of the difference in the adhesion friction coefficient, it is possible, in a particularly reliable manner, taking account of the speed difference between the wrapping belt and the removal belt, for the tension taking effect on the paper cutout to be determined.

According to one advantageous embodiment of the invention, provision is made for the belt speed of the removal belt to be dynamically adjustable. This embodiment of the invention, according to which the removal belt is speeded up when the package combination is no longer in engagement with the wrapping belt, allows for a continuous wrapping process, and avoids intermittent processing. In principle, in this situation the belt speed can be changed in accordance with a fixed programming. According to one advantageous embodiment of the invention, however, a sensor unit can be provided to detect the position of the packing unit and/or to detect the tensile stress taking effect on the rear end of the paper cutout.

The use of a sensor unit to detect the position of the packing unit reliably allows for a disengaged position of the wrapping belt with the package combination to be detected, such that an acceleration of the removal belt can then take place. By means of the sensor unit to detect the tensile stress taking effect on the rear end of the paper cutout, this can be monitored, and, in the defined limit values being exceeded, adjustments can be made to the belt speeds, so that any damage to the paper cutout as a result of excessive tensile stress can be reliably avoided.

The rear end of the paper cutout can in principle be secured to the forward end in any desired manner. According to a further embodiment of the invention, provision is made for this purpose of a closure unit, in particular an adhesive bonding unit and/or a strapping band unit, for securing the rear end of the paper cutout to the forward end of the paper cutout.

An adhesive bonding unit can in this situation be a device by means of which the adhesive is applied in the region between the front and rear ends of the paper cutout, such that they can be secured to one another. As an alternative, the adhesive bonding unit can also be configured for the application of an adhesive strip, by means of which the forward end of a paper cutout is fixed to the rear end of the paper cutout. An advantageously provided strapping band unit allows for the fixing of the forward end of the paper cutout to the rear end of the paper cutout by means of suitable strapping means, such as closure straps, which are tensioned around the individual packages enclosed in the paper cutout in such a way that a reliable securing of the forward end of the paper cutout to the rear end of the paper cutout is ensured.

With one advantageous embodiment of the invention, a storage unit is provided for the paper material, in which the paper material is provided. The paper material can be stored in the storage unit in the form of ready-cut paper cutouts, preferably stacked above one another. As an alternative, the paper material can be stored in the form of a continuous web of material, in particular in the form of a roll. In the latter case, an additional cutting unit is advantageously provided in order to cut the continuous material web into individual paper cutouts.

According to the inventive method, for the formation of bundles from individual packages, in particular liquid containers, by the enclosing of a package combination of grouped individual packages in a cutout made of a packaging material, the following method steps are provided for. The package combination of grouped individual packages, i.e. positioned and aligned in relation to one another, is first transported by means of a wrapping belt of a transport unit into a wrapping unit, in which the package combination is then wrapped with the cutout in the transport direction of the transport unit. In order to produce an overlapping arrangement of the front and rear ends of the cutout, the package combination is removed from the wrapping unit by means of a removal belt of the transport unit.

Characteristic of the method according to the invention in this situation is the fact that the cutout is formed from a paper material, and the package combination is conducted to the wrapping unit, which wraps the package combination with the cutout, by way of the wrapping belt at a higher speed than the package combination is removed from the wrapping unit by way of the removal belt. In this way the situation is attained that, at the transition of the package combination from the wrapping belt onto the removal belt, the rear end of the cutout is pre-tensioned in the direction of the forward end of the cutout.

In the region of the wrapping unit, the package combination is wrapped into the cutout, formed from paper material, referred to hereinafter as the paper cutout. Preferably, in this situation the rear end of the paper cutout is guided by suitable means, such as a guide rod, in the transport direction, around the package combination. After passing through a transport plane, which is formed by an upper side of the wrapping belt and the removal belt, the rear end of the paper cutout is arranged beneath the package combination. At the transition of the package combination from the wrapping belt onto the removal belt, i.e. during the period in which the package combination is in engagement with both the wrapping belt as well as with the removal belt, the rear end is guided under the forward paper end, wherein, due to the removal belt having a slower belt speed than the wrapping belt, a tensile stress is exerted onto the paper cutout in the direction towards the forward end, by means of which the paper cutout is tautened, and is applied taut onto the package combination.

Due to the different belt speeds, in this situation, in a particularly simple and convenient manner, the tensile stress applied to the paper cutout can be determined, which is sufficient to ensure a taut application, which is necessary for the formation of a bundle formed as a stable packaging unit.

The method according to the invention therefore allows, without further means, namely solely by the adjusting of a speed difference between the wrapping belt and the removal belt, for a tautening effect to be exerted on the paper cutout, by means of which a stable bundle can be produced.

In this situation, the speed difference between the wrapping belt and the removal belt can in principle be freely selected. According to a particularly advantageous embodiment of the invention, however, provision can be made for the package combination to be conveyed to the wrapping unit via the wrapping belt at a speed 1.25 to 2 times higher than the package combination is removed from the wrapping unit via the removal belt. A speed difference according to this further embodiment of the invention is characterized in that, by means of this arrangement, an adequate tautening is ensured, wherein, at the same time, the exertion of a tension is exerted onto the paper cutout is prevented which could lead to it being damaged.

According to a further embodiment of the invention, provision is made for the grouped individual packages, before the transport into the wrapping unit, to be grouped on an underlay, in particular a card tray. According to this embodiment of the invention, provision is made for the grouped individual packages to stand upright on a common underlay. The use of such an underlay allows first for the forward end of the paper cutout to be fixed reliably to the grouped individual packages, namely to the flat underlay. As a result, it is then possible, by means of the speed difference between the wrapping belt and the removal belt, for a tension to be applied reliably onto the rear end of the paper cutout, such that a taut application of the paper cutout to the grouped individual packages is achieved. The use of an underlay, in particular of a cardboard tray therefore allows for the possibility of producing a stable packaging unit, wherein, in particular, a cardboard tray further forms an ecological packing for the paper cutout, and allows for a reliable flat connection of the rear end to the forward end.

According to a further embodiment of the invention, provision is made for the speed of the removal belt to be adjusted when the package combination comes out of engagement with the wrapping belt. According to this embodiment, there is the possibility of the speed of the removal belt being dynamically adjusted after the package combination comes out of engagement with the wrapping belt and is then arranged completely on the removal belt. There is then the possibility of increasing the speed of the removal belt in such a way that a reduction in the interval spacing between several packing combinations arranged behind one another, caused by the reduced speed of the removal belt, during the transition of the package combination, is compensated by a belt speed of the removal belt exceeding the belt speed of the wrapping belt. This embodiment of the invention therefore allows for a wrapping of the package combinations to be carried out in one continuous process, such that a start and stop processing can be avoided.

In principle, by means of a fixed speed difference over a fixed period of time, the tensile stress applied onto the paper cutout during the interaction with the removal belt and the wrapping belt can be specified. According to one advantageous embodiment of the invention, however, provision is made for the tensile stress taking effect on the rear end is detected by means of sensors. This embodiment of the invention allows for a continuous monitoring of the tensile strength, and therefore, in the event of a tensile stress exceeding predetermined limit values, allows for an adjustment of the belt speeds to be carried out, such that damage to the paper cutout can be reliably avoided.

According to a further embodiment of the invention, provision is further made for the position and/or the speed of the packing combination and/or the speed of the wrapping belt and the removal belt are detected by means of sensors. The detection of the position and speeds by means of sensors allows for the wrapping process to be continuously monitored, and therefore for adjustments to be made in good time, for example in the event of a tension taking effect on the paper cutout which is insufficient or too high.

The locking or fixing of the rear end of the paper cutout can in principle be carried out in any desired manner. According to one advantageous further embodiment of the invention, however, provision can be made for the rear end of the paper cutout to be fixed in the region of the forward end of the cutout, in particular by adhesive bonding. The use of an adhesive bonding unit in particular for the fixing of the rear end to the forward end represents a particularly reliable possibility of securing the cutout in the taut position on the package combination.

BRIEF DESCRIPTION OF THE DRAWINGS

These and other features of the invention will be apparent from the following detailed description and the accompanying figures, in which.

DETAILED DESCRIPTION

Figure 1:
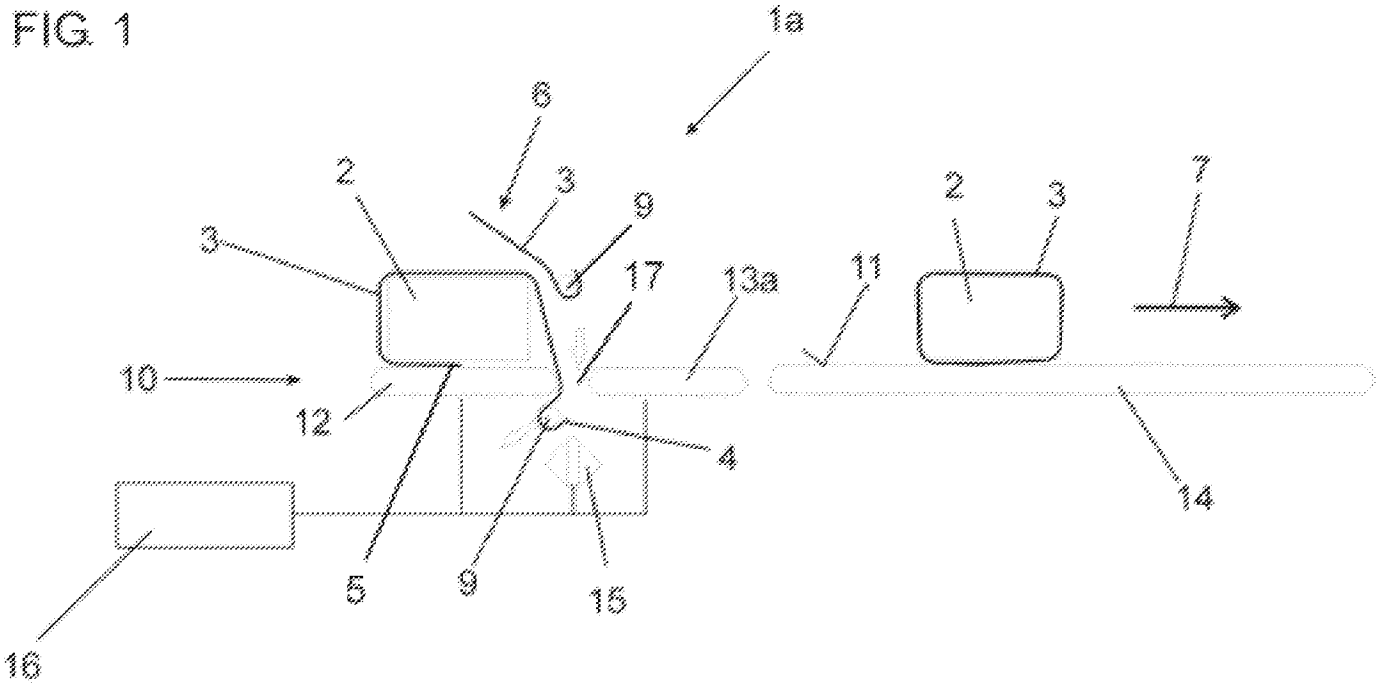
FIG. 1 shows a first embodiment of a bundling machine for forming bundles from individual containers and FIG. 2 shows a second embodiment of a bundling machine for forming bundles from individual containers.

FIG. 1 shows a bundler 1*a* for forming bundles from packages. A typical package is a liquid-filled container. The bundler 1*a* includes a transporter 10 and a wrapper 6.

The transporter 10 comprises a wrapping belt 12, a removal belt 13*a*, and a conveyor belt 14 that are arranged one behind the other along a transport direction 7. The upper sides of the belts 12, 13*a*, 14 define a transport plane 11 for a combination 2 that comprises the packages that are to be bundled.

The wrapping belt 12 and the removal belt 13*a* move the combination 2 of grouped individual packages through the wrapper 6 along the transport direction 7. As the combination 2 moves through the wrapper 6, the wrapper 6 wraps it in a paper cutout 3.

The package combination 2 stands upright during the transport into the wrapper 6. A section of the underside of the package combination 2 stands on a forward end 5 of the paper cutout 5. As a result, during transport, the paper cutout's forward end 5 is arranged between the package combination's underside and the wrapping belt 12.

Within the wrapper 6, the paper cutout 3 is wrapped around the package combination 2 as the package combination 2 moves along the transport direction 7. The wrapper 6 includes a guide bar 9 that guides a rear end 4 of the paper cutout 3 through an opening 17 between the wrapping belt 12 and the removal belt 13*a*, thus bringing the rear end 4 below the transporter 10. FIG. 1 shows the guide bar 9 in a first position, in which it is still above the transporter 10, and a second position, in which it has moved below the transporter 10.

The wrapping belt 12 and the removal belt 13*a* move at different belt speeds. In particular, the removal belt 13*a* moves more slowly than the wrapping belt 12. For a brief period as it is being transported along the transport direction 7, the package combination 2 rests on both the wrapping belt 12 and with the removal belt 13*a*. During this period, the paper cutout's rear end 4 is guided under its forward end 5. Because the removal belt 13*a* moves more slowly than the wrapping belt 12, the rear end 4 sustains a tensile force that is directed towards the forward end 5, thus causing the paper cutout 3 to be tautened. Once the paper cutout's rear end 4 has been brought in contact with its forward end 5, an adhesive-bonding unit bonds the forward end 5 and the rear end 4 together.

The wrapper 6 includes a controller 16 that adjusts the speed of the removal belt 13*a* and a sensor 15 that determines when a combination 2 is no longer in contact with the wrapping belt 12. At this point, the controller 16 accelerates the removal belt 13*a*. This permits the spacing interval between package combinations 2 to be maintained. The removal belt's speed profile also provides a way to determine the interval between wrapped package combinations 2 that are transferred from the removal belt 13*a* to a conveyor belt 14 that is downstream of the removal belt 13*a* and that conveys the package combination 2 to, for example, to a downstream folding unit. This promotes continuous processing of the package combinations 2.

Figure 2:
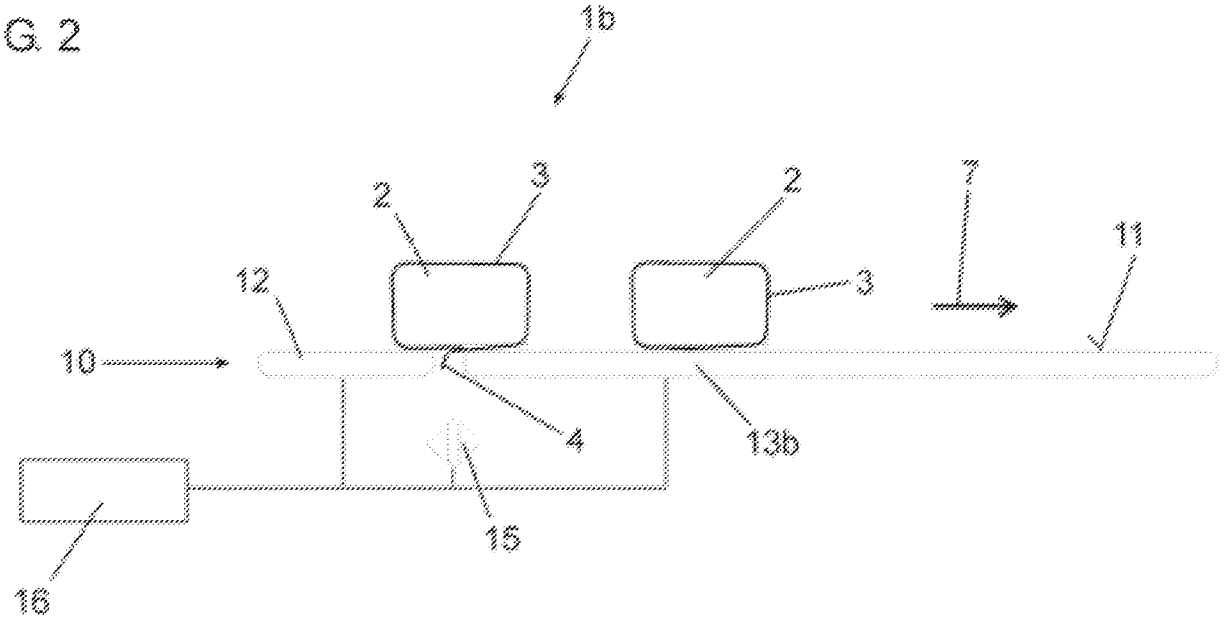

FIG. 2 shows an alternative bundling machine 1*b* that is similar to that shown in FIG. 1 but that omits a separate removal belt 14. In this embodiments, further transport of the wrapped package combinations takes place on a removal belt 13*b* that has a corresponding length.

Having described the invention and a preferred embodiment thereof, what is claimed as new and secured by Letters Patent is:

1. An apparatus comprising a bundling machine for bundling a combination of packages to form a bundle, said packages comprising liquid-filled containers, said bundling machine comprising a wrapper, a transporter, and a controller, wherein said transporter comprises a wrapping belt and a removal belt that follows said wrapping belt along a transport direction for conveying said combination of packages along a transport plane in said transport direction through said wrapper, wherein said wrapper is configured so as to wrap said combination of packages such that said combination of packages rests on a forward end of a paper cutout and a rear end of said paper cutout is made to overlap said forward end of said paper cutout while said combination of packages moves in said transport direction, and wherein said controller controls a relative speed of said wrapping belt and said removal belt in such a way that, while said combination is in contact with both said wrapping belt and said removal belt, said wrapping belt has a belt speed that is higher than that of said removal belt, thereby causing said rear end to sustain a tension in a direction of said forward end.

2. The apparatus of claim 1, wherein said controller is configured to cause said belt speed of said wrapping belt to be between 1.25 and 2 times greater than that of said removal belt.

3. The apparatus of claim 1, further comprising a conveyor belt that is disposed downstream of said removal belt along said transport direction, wherein said removal belt is configured to accommodate only one combination of packages at a time.

4. The apparatus of claim 1, wherein said paper cutout is made from paper, wherein an adhesion friction coefficient between said wrapping belt and said paper exceeds an adhesion friction coefficient between said removal belt and said paper.

5. The apparatus of claim 1, wherein said controller is configured to dynamically adjust said belt speed of said removal belt.

6. The apparatus of claim 1, further comprising a sensor unit for detecting a position of said combination of packages and providing information indicative of said position to said controller, wherein said controller is configured to cause said rear end of said paper cutout to be guided under said forward end while said information indicates that said combination is on both said wrapping belt and said removal belt.

7. The apparatus of claim 1, further comprising a sensor unit for detecting tensile stress sustained by said rear end of said paper cutout.

8. The apparatus of claim 1, wherein said bundling machine is further configured to adhesively bond said rear end of said paper cutout and said forward end of said paper cutout.

9. The apparatus of claim 1, wherein said combination is one of a plurality of combinations, wherein said apparatus further comprises a sensor that determines when said combination is no longer in contact with said wrapping belt and provides information indicative of said combination no longer being in contact with said wrapping belt to said controller, wherein, in response to receiving said information, said controller accelerates said removal belt so as to maintain a spacing interval between said combinations.

10. The apparatus of claim 1, wherein said combination is one of a plurality of combinations that are transformed into wrapped combinations, wherein said apparatus further comprises a conveyor belt that is downstream of said removal belt, wherein said controller uses a speed profile of said removal belt to determine an interval between wrapped combinations that are transferred to said conveyor belt.

11. A method comprising: forming a bundle of packages from a combination of said packages, said packages comprising liquid-filled containers, wherein forming said bundle comprises using a wrapping belt of a transporter to transport said combination into a wrapper; while said combination is in said wrapper, wrapping said combination with a paper cutout along a transport direction of said transporter; causing a front end of said paper cutout to overlap with a rear end of said paper cutout, said overlapping ends being in contact with said wrapping belt; and using a removal belt of said transporter to remove said combination of said packages from said wrapper; wherein said wrapping belt conveys said combination of said packages into said wrapper at a higher speed than a speed at which said removal belt removes said combination of said packages from said wrapper.

12. The method of claim 11, further comprising conveying said combination of said packages to said wrapper via said wrapping belt at a speed that is 1.25 to 2 times higher than a speed at which said combination of said packages is removed from said wrapper via said removal belt.

13. The method of claim 11, further comprising, prior to transporting said combination of said packages into said wrapper, resting said packages, as a group, onto a cardboard tray.

14. The method of claim 11, further comprising comparing a speed of said removal belt to a speed of said wrapping belt when said combination of said packages comes out of engagement with said wrapping belt.

15. The method of claim 11, further comprising detecting a position of said combination of said packages, a speed of said combination of said packages, a speed of said wrapping belt, and a speed of said removal belt.

16. The method of claim 11, further comprising using a sensor to detect tensile stress sustained by said rear end.

17. The method of claim 11, further comprising fixing said rear end to said front end of said paper cutout.

18. The method of claim 11, further comprising increasing the speed of the removal belt from less than that of the wrapping belt to greater than that of the wrapping belt.

* * * * *